US006711363B1

(12) United States Patent
Wayman

(10) Patent No.: US 6,711,363 B1
(45) Date of Patent: Mar. 23, 2004

(54) METHOD OF DETERMINING A CHARGING DEVICE PRE-FAULT STATUS, A PRINTING MACHINE ARRANGED WITH THE SAME METHOD, A METHOD OF FORMING A CHARGING DEVICE SERVICE MESSAGE AND A METHOD OF TRIGGERING A CLEANING CYCLE

(75) Inventor: William H. Wayman, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/462,329

(22) Filed: Jun. 16, 2003

(51) Int. Cl.[7] ..... G03G 15/00

(52) U.S. Cl. ..... 399/31; 399/37; 399/100

(58) Field of Search ..... 361/86, 91.2; 399/31, 399/37, 91, 98, 99, 100, 115, 168, 170, 171, 172, 173

(56) References Cited

U.S. PATENT DOCUMENTS 4,777,554 A * 10/1988 Gokita ..... 361/91.2
6,449,447 B1 * 9/2002 Regelsberger et al. ..... 399/100

* cited by examiner

*Primary Examiner*—Hoang Ngo
(74) *Attorney, Agent, or Firm*—Wayne J. Egan

(57) ABSTRACT

A printing machine comprises a charging device that forms a variable operating voltage. A charging device pre-fault status condition is determined by sampling the charging device operating voltage, forming a slope value based on a charging device operating voltage rate of change per unit time, and determining when the slope value falls in a charging device pre-fault status range of values. When the pre-fault status determination is made, a message is formed based on a current print count value. This message is then sent to a user or operator. When the print count value falls in a charging device replacement range of values, a replacement message is sent to inform that the charging device needs to be replaced. Otherwise, when the print count value does not fall in this range of values, a cleaning message is sent to inform that the charging device needs to be cleaned.

72 Claims, 5 Drawing Sheets

METHOD OF DETERMINING A CHARGING DEVICE PRE-FAULT STATUS, A PRINTING MACHINE ARRANGED WITH THE SAME METHOD, A METHOD OF FORMING A CHARGING DEVICE SERVICE MESSAGE AND A METHOD OF TRIGGERING A CLEANING CYCLE

FIELD OF THE INVENTION

This application relates generally to xerographic charging devices and more particularly to determining a pre-fault status condition in such charging devices.

BACKGROUND OF THE INVENTION

Xerographic printing machines are known. It is known that some xerographic engines have a problem with frequent DC pin scorotron "pin arcs". The root cause is believed to be as a result of pin and/or grid contamination. Contamination can be the result of fuser silicone oil volitles getting into the xerographic cavity, which form silica dendrites on the pins and/or grids of charging devices. There is also the and possibly of pin and/or grid contamination with paper dust, toner and or toner additives. Pin scorotrons are typically operated under closed loop feedback control with a constant current maintained between the pins and grid. The voltage required to maintain this constant current is called the "operating voltage". Pin and/or grid contamination will cause a variation in this operating voltage. Furthermore the contamination can vary in its electrical conductivity as a function device operation history (powered/unpowered). This contamination conductivity variation is likely the root cause of the operating voltage variation.

When a pin to grid arc occurs, the print engine does an immediate hard-down, requiring clearing of the paper path, a time consuming job. The arc energy is high enough to disrupt communications, which can require a re-boot to restore the machine to operation. Regardless of the mature machine interval between arcs, it is advantageous to predict when a pin arc is likely to occur.

BRIEF SUMMARY OF THE INVENTION

In a first aspect of the invention, there is described a method of determining a charging device pre-fault status, the charging device forming a charging device operating voltage that varies with time, the charging device comprising an included printing machine, the method comprising sampling the charging device operating voltage, forming a slope value based on a charging device operating voltage rate of change per unit time, and determining when the slope value falls in a charging device pre-fault status range of values.

In a second aspect of the invention, there is described a printing machine comprising a charging device, the charging device forming a charging device operating voltage that varies with time, the printing machine arranged to determine a charging device pre-fault status in accordance with a method, the method comprising sampling the charging device operating voltage, forming a slope value based on an charging device operating voltage rate of change per unit time, and determining when the slope value falls in a charging device pre-fault status range of values.

In a third aspect of the invention, there is described a method of forming a charging device service message based on a charging device operating voltage that varies with time, the charging device comprising an included printing machine, the method comprising sampling the charging device operating voltage, forming a slope value based on a charging device operating voltage rate of change per unit time, and forming a charging device service message when the slope value falls in a charging device pre-fault status range of values.

In a fourth aspect of the invention, there is described a method of triggering a cleaning cycle based on a charging device operating voltage that varies with time, the charging device comprising an included printing machine, the method comprising sampling the charging device operating voltage, forming a slope value based on a charging device operating voltage rate of change per unit time, and triggering a cleaning cycle in an included automatic cleaning system when the slope value falls in a charging device pre-fault status range of values.

DETAILED DESCRIPTION OF THE INVENTION

Briefly, a printing machine comprises a charging device that forms a variable charging device operating voltage. A charging device pre-fault status condition indicates that a charging device fault condition is likely to occur. The printing machine determines the charging device pre-fault status condition by a method comprising sampling the operating voltage; forming a slope value based on a charging device operating voltage rate of change per unit time; and determining when the slope value falls in a charging device pre-fault status range of values. When the charging device pre-fault status determination is made, one of several messages is formed based on a current print count value. This message is then sent to a user or operator by means of an included display unit, internal communication network, or wireless or radio frequency communication network. When the print count value falls in a charging device replacement range of values, a replacement message is sent to inform the user or operator that the charging device needs to be replaced. Otherwise, when the print count value does not fall in this range of values, a cleaning message is sent to inform the user or operator that the charging device needs to be cleaned.

As a result of the present invention, monitoring of the charging device pin to grid voltage time track enables the machine control system to anticipate an upcoming pin arc event. The operator can then be notified (before an arc occurs) to clean or replace the charging device.

In one typical printing machine, the pin scorotron charging device operates on a constant current of 2.085 mA. The power supply output voltage varies to maintain this constant pin current. A pin voltage monitor signal is available to the machine control system along with the grid voltage. The pin to grid voltage can be calculated. Data show the pattern of decreasing pin to grid voltage and more voltage swinging before an arc occurs. New or well-cleaned charging devices do not exhibit this decrease in pin to grid voltages.

In accordance with the present invention, the pin to grid voltage signature is used as a fault trigger. The fault is used to instruct the operator to clean the device before an arc occurs. For example, the fault can be triggered if the pin to grid voltage variation is more than 100 volts in the last 60 seconds of operation.

Alternatively, the fault can look at the High Frequency Service Interval cleaning interval remaining on the faulted charging device and instruct the operator to clean or replace the charging device depending on the run time since the last cleaning. A charging device that trips the "Anticipated Arc Soon" fault shortly after a previous cleaning would be replaced. A fault that occurs close to the cleaning interval would instruct the operator to clean the device.

Figure 1:
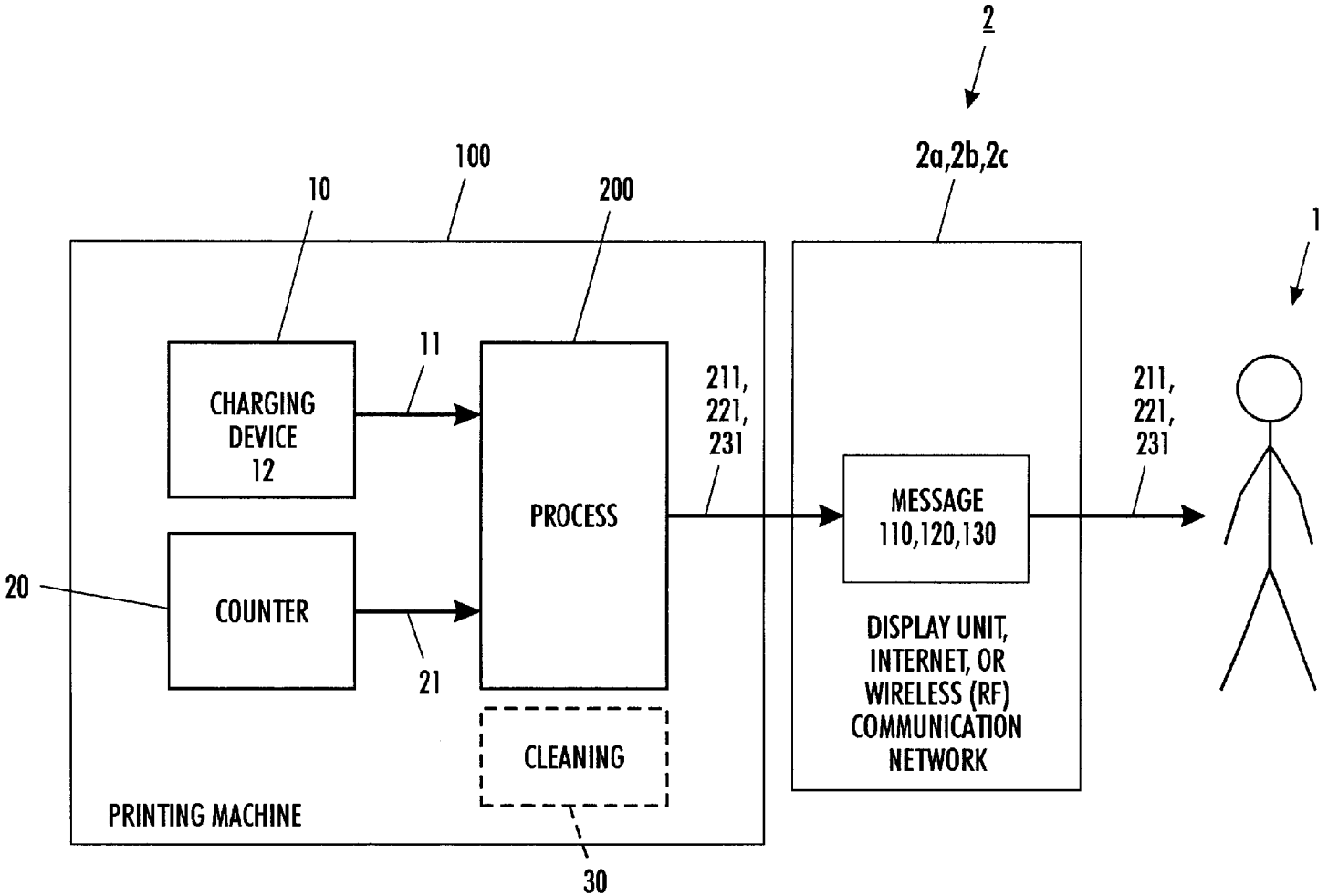
FIG. 1 depicts a printing machine 100. An included charging device 10 forms a charging device operating voltage 11. The printing machine 100 determines a charging device 10 pre-fault status condition based on an included method 200. Messages 110, 120 and 130 are sent to a user or operator 1 by means of any of an included display unit 2*a*, internet communication network 2*b*, or wireless or radio frequency communication network 2*c*. The printing machine 100 optionally includes an automatic cleaning system 30.

Referring now to FIG. 1, there is depicted a printing machine 100 coupled to any of a display unit 2*a*, internet communication network 2*b*, or wireless or radio frequency communication network 2*c*. Items 2*a*, 2*b* and 2*c* are collectively designated reference number 2.

In a first embodiment, the printing machine 100 comprises a copier.

In a second embodiment, the printing machine 100 comprises a network printer.

In a third embodiment, the printing machine 100 comprises a facsimile machine.

Printing machine 100 includes a charging device 10 that forms a charging device operating voltage 11 that varies with time.

In one embodiment, the operating voltage 11 is based on a charging device 10 pin to grid differential voltage that results from constant pin to grid current operation.

In one embodiment, the printing machine 100 includes a counter 20 that forms a print count value 21.

In one embodiment, the print count value 21 is based on a total number of copies made using the charging device 10 since a first event of the charging device 10's installation or a second event of the charging device 10's most-recent cleaning, whichever event occurred last.

The printing machine 100 determines a charging device 10 pre-fault status condition in accordance with an included method 200. The charging device 10 pre-fault status indicates that a changing device fault condition is likely to occur.

In one embodiment, the charging device 10 fault condition comprises a pin to grid arcing.

In accordance with the method 200, various messages 110, 120 and 130 are formed and sent 211, 221 and 231 to a user or operator 1 by means of any of the items 2.

Figure 2A:
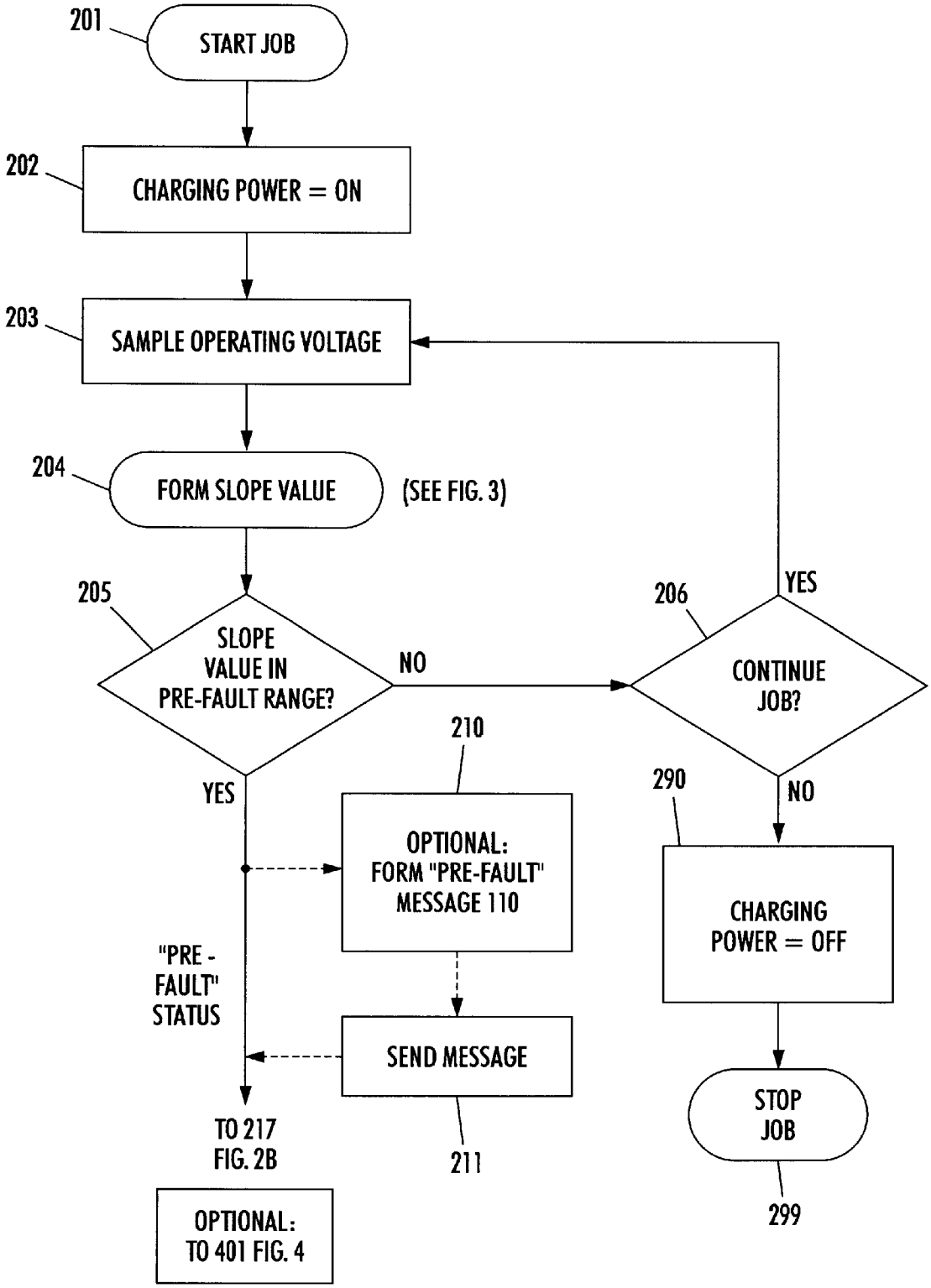
FIGS. 2A and 2B depict the method 200.
Figure 2B:
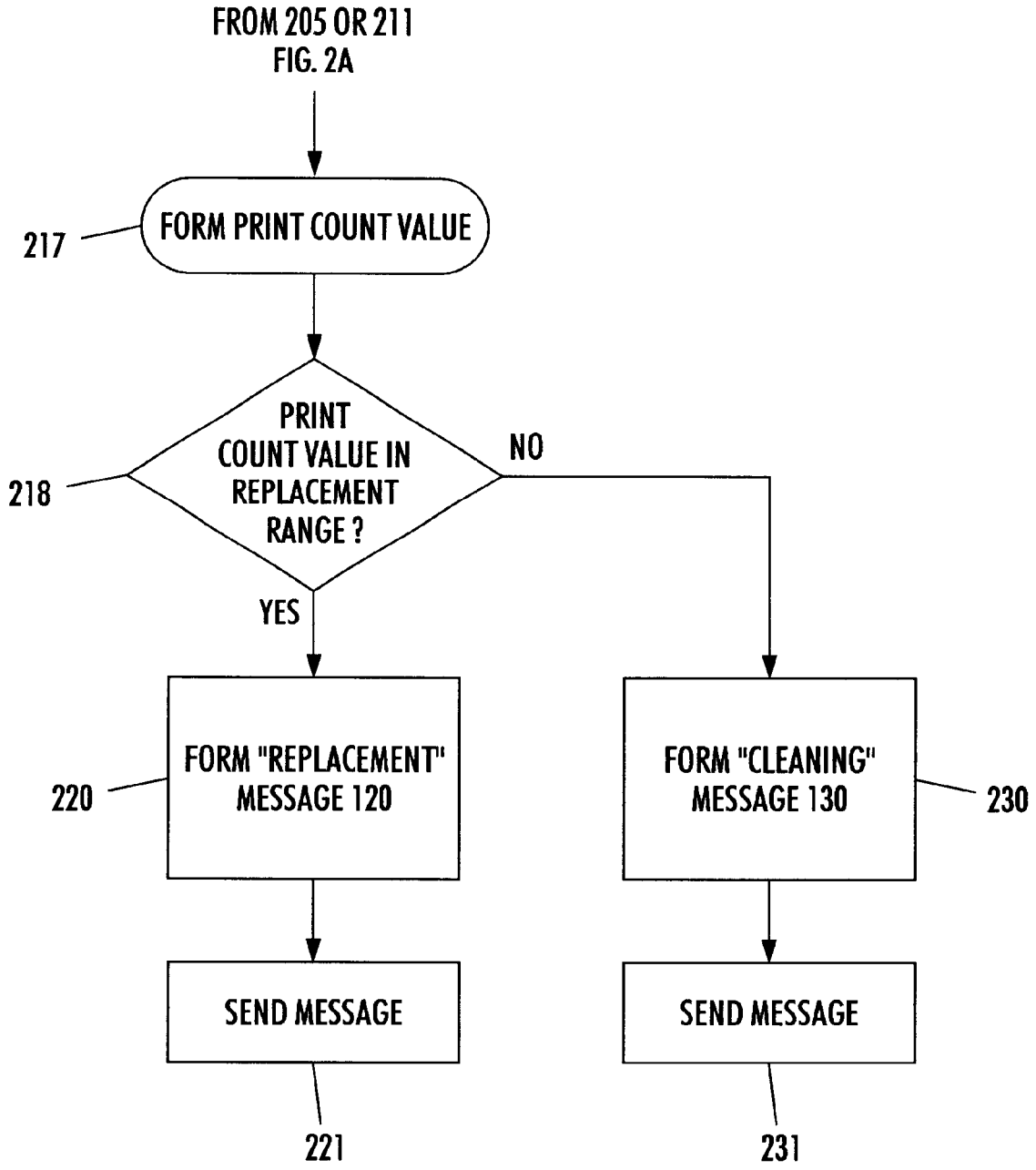

FIGS. 2A and 2B depict the method 200.

Referring now to FIG. 2A, the method begins with starting a print job, step 201. The method then goes to step 202.

In step 202 charging power is applied to the charging device 10. The method then goes to step 203.

In step 203 the charging device operating voltage 11 is sampled. The method then goes to step 204.

In step 204 a slope value is formed based on a charging device operating voltage 11 rate of change per unit time.

In one embodiment, in step 204 the slope value is formed based on the optional steps 301, 302 and 303 that are described below in connection with FIG. 3.

In another embodiment, in step 204 the slope value is formed based on any suitable process.

After forming the slope value in step 204, the process goes to step 205.

In step 205 it is determined when the slope value falls in a charging device pre-fault status range of values.

In one embodiment, the charging device pre-fault status range of values comprise slope values greater than a first threshold.

In another embodiment, the charging device pre-fault status range of values comprise slope values less than a second threshold.

In still another embodiment, the charging device pre-fault status range of values comprise slope values greater than a first threshold and slope values less than a second threshold. Optionally, in one embodiment, the first threshold equals the absolute value of the second threshold.

Still referring to step 205, when the slope value falls in the charging device pre-fault status range of values, the step 205 determination is positive.

In one embodiment, after this step 205 positive determination the process goes in sequence to steps 210 and 211, depicted in FIG. 2A, and then to step 217, depicted in FIG. 2B. However, in another embodiment, after this step 205 positive determination the process goes directly to step 217, depicted in FIG. 2B.

Still referring to step 205, when the slope value does not fall in the charging device pre-fault status range of values, the step 205 determination is negative and the process goes to step 206.

In step 206, the process determines when to continue the current printing job.

When the current printing job continues, the determination 206 is positive and the process returns to step 203.

Otherwise, when the current printing job does not continue, the determination 206 is negative and the process goes to step 290.

In step 290 charging power is removed from the charging device 10. The process then goes to step 299.

In step 299 the current printing job stops.

Steps 210 and 211 are now described.

In step 210 a charging device pre-fault status message 110 is formed. The message 110 indicates that a charging device 10 fault condition is likely to occur. The process then goes to step 211.

In step 211 the charging device pre-fault status message 110 is sent to the user or operator 1 by means of any of the display unit 2*a*, the internet communication network 2*b* or the wireless or radio frequency communication network 2*c*. The process then goes to step 217, depicted in FIG. 2B.

Referring now to FIG. 2B, in step 217 a current print count value 21 is formed.

In one embodiment, the current print count value 21 is formed by an included counter 20.

In another embodiment, the print count value 21 is formed by any suitable means.

The process then goes to step 218.

In step 218 it is determined when the print count value 21 falls in a charging device replacement range of values.

Still referring to step 218, when the print count value 21 falls in the charging device replacement range of values, the step 218 determination is positive and the process goes in sequence to steps 220 and 221.

In step 220 a charging device replacement message 120 is formed. The charging device replacement message 120 indicates that the charging device 10 needs to be replaced. The process then goes to step 221.

In step 221 the charging device replacement message 120 is sent to the user or operator 1 by means of any of the display unit 2*a*, the internet communication network 2*b* or the wireless or radio frequency communication network 2*c*.

Still referring to step 218, when the print count value 21 does not fall in the charging device replacement range of values, the step 218 determination is negative and the process goes in sequence to steps 230 and 231.

In step 230 a charging device cleaning message 130 is formed. The charging device cleaning message 130 indicates that the charging device 10 needs to be cleaned. The process then goes to step 231.

In step 231 the charging device cleaning message 130 is sent to the user or operator 1 by means of any of the display unit 2*a*, the internet communication network 2*b* or the wireless or radio frequency communication network 2*c*.

Figure 3:
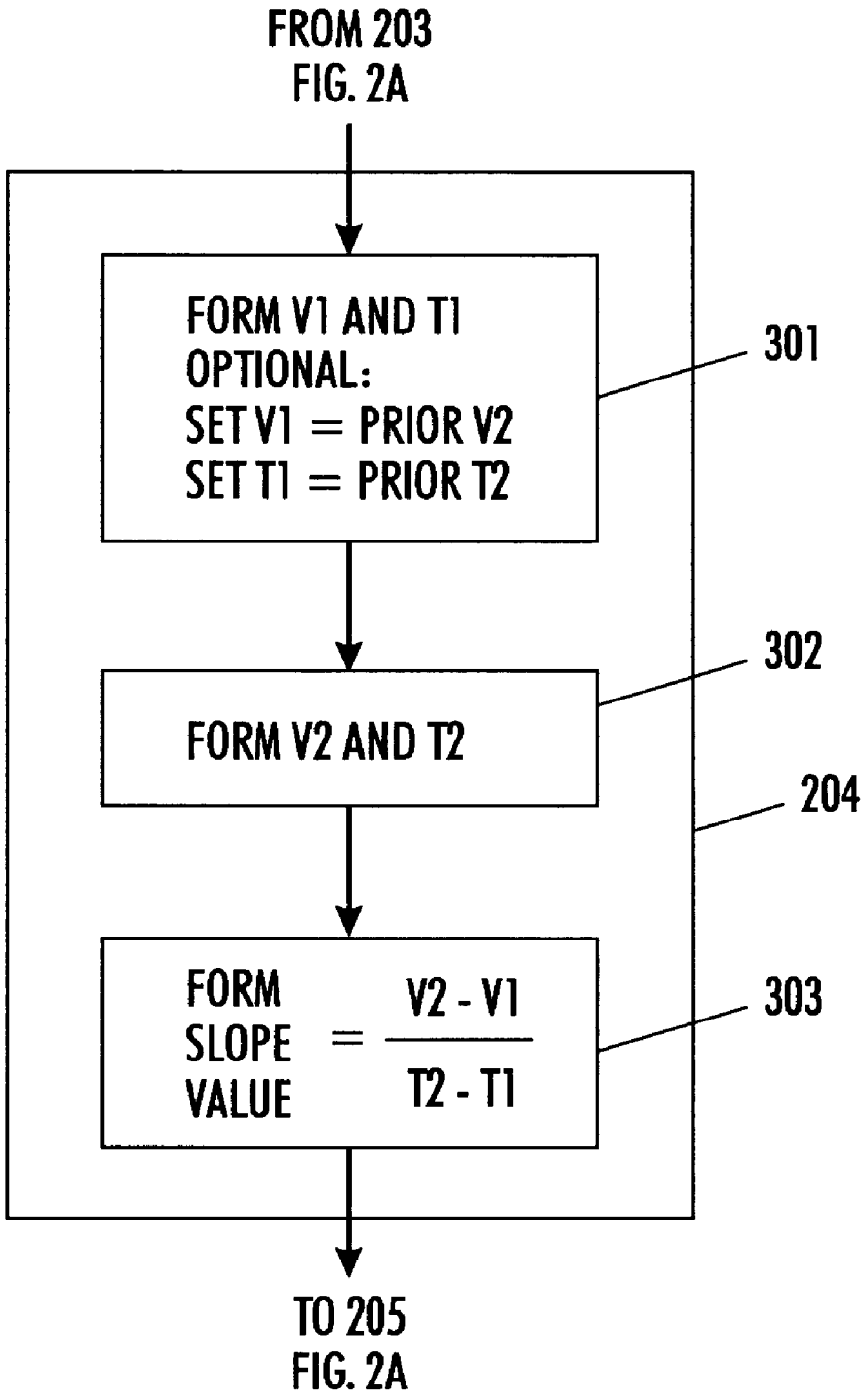
FIG. 3 depicts an optional embodiment of step 204 in FIG. 2A.

Referring to FIG. 3 there is depicted an optional embodiment of the step 204 of FIG. 2A. Thus, the depicted steps 301, 302 and 303 comprise one possible method to form the slope value in step 204 of FIG. 2A.

Referring to step 301, in one embodiment, the process forms a first charging device operating voltage 11 value, V1, at a first time, T1. (Note that an alternate embodiment of step 301 is described below.) The process then goes to step 302.

In step 302 the process forms a second charging device operating voltage 11 value, V2, at a second time, T2. The process then goes to step 303.

In step 303 the process forms a slope value equal to a ratio of a difference of the second charging device operating voltage 11 value, V2, and the first charging device operating voltage 11 value, V1 and a difference of the second time, T2, and the first time, T1. Thus, in step 303 the process forms a slope value equal to (V2−V1) divided by (T2−T1).

Referring still to FIG. 3, with momentary cross-reference back to FIG. 2A, it will be understood that the sequence of steps 301–303 is repeatedly performed while the current printing job continues to run. Hence, in an alternate embodiment, in step 301 the first charging device operating voltage 11 value, V1, is set to the value of the second charging device operating voltage 11 value, V2, that was formed in the prior step 302 in the prior iteration of the sequence of steps 301–303, and the first operating time, T1, is set to the second time, T2, that was formed during the same prior step 302 in the same prior iteration of the sequence of steps 301–303.

Referring again to steps 218, in one embodiment, the charging device replacement range of values is based on a charging device 10 target cleaning interval.

For example, in one embodiment the target cleaning interval is 1,000 copies and the charging device replacement range of values is less than 500 copies.

In this example, first assume that when the charging device pre-fault status is determined to exist by step 205, the corresponding print count value determined by step 217 is 490 copies. In this case, step 218 determines that the print count value (490 copies) falls in the replacement range of values (less than 500 copies). As a result, the step 218 determination is positive, and so a charging device replacement message 120 is formed by step 220 and sent by step 221 to the user or operator 1.

In this same example, now second assume that when the charging device pre-fault status is determined to exist by step 205, the corresponding print count value determined by step 217 is 910 copies. In this case, step 218 determines that the print count value (910 copies) does not fall in the replacement range of values (less than 500 copies). As a result, the step 218 determination is negative, and so a charging device cleaning message 130 is formed by step 230 and sent by step 231 to the user or operator 1.

Figure 4:
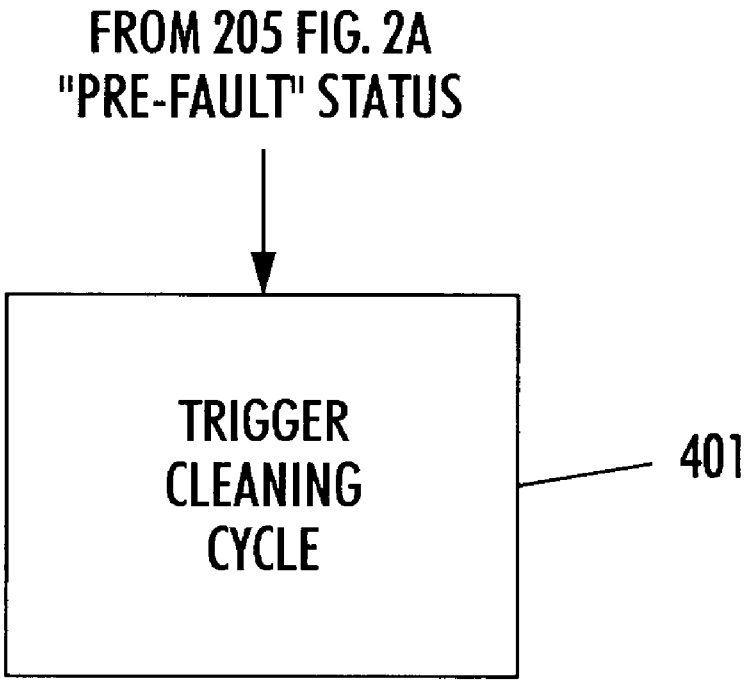
FIG. 4 depicts an optional step 401 of triggering a cleaning cycle.

Referring again to FIG. 1, in one embodiment, the printing machine 100 comprises an automatic cleaning system 30. In this embodiment, the pre-fault status determining step 205, depicted in FIG. 2A, is used to trigger the cleaning cycle on the next cycle down, this triggering depicted as step 401 in FIG. 4.

Thus, there has been described a method 200 of determining a charging device 10 pre-fault status, the charging device 10 forming a charging device operating voltage 11 that varies with time, the charging device 10 comprising an included printing machine 100, the method 200 comprising sampling (step 203) the charging device operating voltage 11, forming (step 204) a slope value based on a charging device operating voltage 11 rate of change per unit time, and determining (step 205) when the slope value falls in a charging device pre-fault status range of values.

Further, there has been described a printing machine 100 comprising a charging device 10, the charging device 10 forming a charging device operating voltage 11 that varies with time, the printing machine 100 arranged to determine a charging device 10 pre-fault status in accordance with a method 200, the method 200 comprising sampling (step 203) the charging device operating voltage 11, forming (step 204) a slope value based on an charging device operating voltage 11 rate of change per unit time, and determining (step 205) when the slope value falls in a charging device pre-fault status range of values.

Further, there has been described a method 200 of forming a charging device 10 service message (the charging device replacement message 120 and the charging device cleaning message 130) based on a charging device 10 operating voltage 11 that varies with time, the charging device 10 comprising an included printing machine 100, the method 200 comprising sampling (step 203) the charging device operating voltage 11, forming (step 204) a slope value based on a charging device operating voltage 11 rate of change per unit time, and forming (step 220 and step 230) a charging device service message (the charging device replacement message 120 and the charging device cleaning message 130) when (step 205 determines that) the slope value falls in a charging device pre-fault status range of values.

Further, there has been described a method 200 of triggering 401 a cleaning cycle based on a charging device 10 operating voltage 11 that varies with time, the charging device 10 comprising an included printing machine 100, the method 200 comprising sampling (step 203) the charging device operating voltage 11, forming (step 204) a slope value based on a charging device operating voltage 11 rate of change per unit time, and triggering 401 a cleaning cycle in an included automatic cleaning system 30 when (step 205 determines that) the slope value falls in a charging device pre-fault status range of values.

The table below lists the drawing element reference numbers together with their corresponding written description:

| Number: | Description: |
|---|---|
| 1 | operator or user |
| 2a | display unit |
| 2b | internet communication network |
| 2c | wireless or radio frequency communication network |
| 2 | any of 2a, 2b and 2c |
| 10 | charging device |
| 11 | operating voltage |
| 12 | charging device pin to grid differential voltage |
| 20 | print counter |
| 21 | print count value |
| 30 | optional automatic cleaning system |
| 100 | printing machine (copier, network printer or facsimile) |
| 110 | charging device pre-fault status message |
| 120 | charging device replacement message |
| 130 | charging device cleaning message |
| 200 | method of determining a charging device pre-fault status |
| 201 | start print job |
| 202 | charging device power = on |
| 203 | sampling the charging device operating voltage |
| 204 | forming a slope value |
| 301 | forming a first charging device operating voltage value at a first time |
| 302 | forming a second charging device operating voltage value at a second time |
| 303 | forming a ratio of the difference of the second and first charging device operating voltage values and a difference of the second and first times |
| 205 | determining when the slope value falls in a charging device pre-fault status range of values |
| 206 | continue job? |
| 207 | forming a print count value |
| 208 | determining when the print count value falls in a charging device replacement range of values |
| 210 | forming a charging device pre-fault status message |
| 211 | sending the charging device pre-fault status message |
| 220 | forming a charging device replacement message |
| 221 | sending the charging device replacement message |
| 230 | forming a charging device cleaning message |
| 231 | sending the charging device cleaning message |
| 290 | charging device power = off |
| 299 | stop print job |
| 401 | trigger the cleaning cycle on the next cycle down |

While various embodiments of a method of determining a charging device pre-fault status, a printing machine arranged with the same method, a method of forming a charging device service message and a method of triggering a cleaning cycle, in accordance with the present invention, have been described hereinabove, the scope of the invention is defined by the following claims.

What is claimed is:

1. A method of determining a charging device pre-fault status, the charging device forming a charging device operating voltage that varies with time, the charging device comprising an included printing machine, the method comprising:

sampling the charging device operating voltage;

forming a slope value based on a charging device operating voltage rate of change per unit time; and determining when the slope value falls in a charging device pre-fault status range of values.

2. The method of claim 1, the charging device operating voltage based on a charging device pin to grid differential voltage.

3. The method of claim 1, the charging device pre-fault status range of values comprising slope values greater than a first threshold.

4. The method of claim 1, the charging device pre-fault status range of values comprising slope values less than a second threshold.

5. The method of claim 1, the charging device pre-fault status range of values comprising slope values greater than a first threshold and slope values less than a second threshold.

6. The method of claim 5 the first threshold equal to the absolute value of the second threshold.

7. The method of claim 1 the slope value based on forming a first charging device operating voltage value at a first time, forming a second charging device operating voltage value at a second time and forming a ratio of a difference of the second and first charging device operating voltage values and a difference of the second and first times.

8. The method of claim 1 including forming a charging device pre-fault status message indicating that a charging device fault condition is likely to occur.

9. The method of claim 8 including forming the charging device pre-fault status message when the slope value falls in the charging device pre-fault status range of values.

10. The method of claim 8 the fault condition comprising a pin to grid arcing.

11. The method of claim 8 including sending the charging device pre-fault status message to a user or operator.

12. The method of claim 11 the charging device pre-fault status message sent by a display unit.

13. The method of claim 11 the charging device pre-fault status message sent by an internet communication network.

14. The method of claim 11 the charging device pre-fault status message sent by a wireless or radio frequency communication network.

15. The method of claim 1 including forming a print count value based on a total number of copies made since an installation or a last cleaning of the charging device.

16. The method of claim 15 including forming the print count value when the slope value falls in the charging device pre-fault status range of values.

17. The method of claim 15 including determining when the print count value falls in a charging device replacement range of values.

18. The method of claim 17 including forming a charging device replacement message indicating that the charging device needs to be replaced.

19. The method of claim 18 including forming the charging device replacement message when the print count value falls in the charging device replacement range of values.

20. The method of claim 18 including sending the charging device replacement message to a user or operator.

21. The method of claim 20 the charging device replacement message sent by a display unit.

22. The method of claim 20 the charging device replacement message sent by an internet communication network.

23. The method of claim 20 the charging device replacement message sent by a wireless or radio frequency communication network.

24. The method of claim 17 including forming a charging device cleaning message indicating that the charging device needs to be cleaned.

25. The method of claim 24 including forming the charging device cleaning message when the print count value does not fall in the charging device replacement range of values.

26. The method of claim 24 including sending the charging device cleaning message to a user or operator.

27. The method of claim 26 the charging device cleaning message sent by a display unit.

28. The method of claim 26 the charging device cleaning message sent by an internet communication network.

29. The method of claim 26 the charging device cleaning message sent by a wireless or radio frequency communication network.

30. The method of claim 1 the printing machine comprising a copier.

31. A printing machine comprising a charging device, the charging device forming a charging device operating voltage that varies with time, the printing machine arranged to determine a charging device pre-fault status in accordance with a method, the method comprising:

sampling the charging device operating voltage;

forming a slope value based on an charging device operating voltage rate of change per unit time; and determining when the slope value falls in a charging device pre-fault status range of values.

32. The printing machine of claim 31, the charging device operating voltage based on a charging device pin to grid differential voltage.

33. The printing machine of claim 31, the charging device pre-fault status range of values comprising slope values greater than a first threshold.

34. The printing machine of claim 31, the charging device pre-fault status range of values comprising slope values less than a second threshold.

35. The printing machine of claim 31, the charging device pre-fault status range of values comprising slope values greater than a first threshold and slope values less than a second threshold.

36. The printing machine of claim 35 the first threshold equal to the absolute value of the second threshold.

37. The printing machine of claim 31 the slope value based on forming a first charging device operating voltage value at a first time, forming a second charging device operating voltage value at a second time and forming a ratio of a difference of the second and first charging device operating voltage values and a difference of the second and first times.

38. The printing machine of claim 31 the method including forming a charging device pre-fault status message indicating that a charging device fault condition is likely to occur.

39. The printing machine of claim 38 the method including forming the charging device pre-fault status message when the slope value falls in the charging device pre-fault status range of values.

40. The printing machine of claim 38 the fault condition comprising a pin to grid arcing.

41. The printing machine of claim 38 the method including sending the charging device pre-fault status message to a user or operator.

42. The printing machine of claim 41 the charging device pre-fault status message sent by a display unit.

43. The printing machine of claim 41 the charging device pre-fault status message sent by an internet communication network.

44. The printing machine of claim 41 the charging device pre-fault status message sent by a wireless or radio frequency communication network.

45. The printing machine of claim 31 the method including forming a print count value based on a total number of copies made since an installation or a last cleaning of the charging device.

46. The printing machine of claim 45 the method including forming the print count value when the slope value falls in the charging device pre-fault status range of values.

47. The printing machine of claim 45 the method including determining when the print count value falls in a charging device replacement range of values.

48. The printing machine of claim 47 the method including forming a charging device replacement message indicating that the charging device needs to be replaced.

49. The printing machine of claim 48 the method including forming the charging device replacement message when the print count value falls in the charging device replacement range of values.

50. The printing machine of claim 48 the method including sending the charging device replacement message to a user or operator.

51. The printing machine of claim 50 the charging device replacement message sent by a display unit.

52. The printing machine of claim 50 the charging device replacement message sent by an internet communication network.

53. The printing machine of claim 50 the charging device replacement message sent by a wireless or radio frequency communication network.

54. The printing machine of claim 47 the method including forming a charging device cleaning message indicating that the charging device needs to be cleaned.

55. The printing machine of claim 54 the method including forming the charging device cleaning message when the print count value does not fall in the charging device replacement range of values.

56. The printing machine of claim 54 the method including sending the charging device cleaning message to a user or operator.

57. The printing machine of claim 56 the charging device cleaning message sent by a display unit.

58. The printing machine of claim 56 the charging device cleaning message sent by an internet communication network.

59. The printing machine of claim 56 the charging device cleaning message sent by a wireless or radio frequency communication network.

60. The printing machine of claim 31 comprising a copier.

61. The printing machine of claim 31 comprising a network printer.

62. The printing machine of claim 31 comprising a facsimile machine.

63. The printing machine of claim 31 comprising an automatic cleaning system, including triggering the cleaning cycle on the next cycle down.

64. A method of forming a charging device service message based on a charging device operating voltage that varies with time, the charging device comprising an included printing machine, the method comprising:

sampling the charging device operating voltage;

forming a slope value based on a charging device operating voltage rate of change per unit time; and forming a charging device service message when the slope value falls in a charging device pre-fault status range of values.

65. The method of claim 64 including forming a print count value and forming the charging device service message based on the print count value.

66. The method of claim 65 including forming a charging device replacement message when the print count value falls in a charging device replacement range of values.

67. The method of claim 66 including forming a charging device cleaning message when the print count value does not fall in the charging device replacement range of values.

68. The method of claim 67 including sending the charging device service message to a user or operator.

69. The method of claim 68 the charging device service message sent by a display unit.

70. The method of claim 68 the charging device service message sent by an internet communication network.

71. The method of claim 68 the charging device service message sent by a wireless or radio frequency communication network.

72. A method of triggering a cleaning cycle based on a charging device operating voltage that varies with time; the charging device comprising an included printing machine, the method comprising:

sampling the charging device operating voltage;

forming a slope value based on a charging device operating voltage rate of change per unit time; and triggering a cleaning cycle in an included automatic cleaning system when the slope value falls in a charging device pre-fault status range of values.

* * * * *